US005323895A

United States Patent [19]

Sutherland et al.

[11] Patent Number: 5,323,895

[45] Date of Patent: Jun. 28, 1994

[54] BOTTLE CARRIER

[75] Inventors: Robert L. Sutherland, Kennesaw; Randall L. Harris, Powder Springs, both of Ga.

[73] Assignee: Riverwood International Corporation, Atlanta, Ga.

[21] Appl. No.: 83,129

[22] Filed: Jun. 24, 1993

[51] Int. Cl.[5] ..... B65D 75/00

[52] U.S. Cl. ..... 206/147; 206/161

[58] Field of Search ..... 206/145, 147, 148, 151, 206/152, 153, 161, 158

[56] References Cited

U.S. PATENT DOCUMENTS

| | | | |
|---|---|---|---|
| 2,397,716 | 4/1946 | Wendler | 206/148 |
| 2,654,474 | 10/1953 | Ringler | 206/158 |
| 3,528,697 | 9/1970 | Wood | 206/158 X |
| 4,850,478 | 7/1989 | Kidd | 206/147 |

FOREIGN PATENT DOCUMENTS

| | | | |
|---|---|---|---|
| 046133 | 2/1982 | European Pat. Off. | 206/145 |
| 460341 | 12/1991 | European Pat. Off. | 206/161 |

*Primary Examiner*—William I. Price

[57] ABSTRACT

A bottle carrier of the type employing support tabs at the periphery of bottle neck, openings for engaging the underside of shoulders on the bottles. The carrier is comprised of two plies, each containing aligned bottle openings and each opening being surrounded by support tabs. In one embodiment the support tabs of an opening in one ply are connected to the ply along fold lines which are at an angle to the fold lines of the tabs of the corresponding opening in the other ply so that the edges of the tabs engage the shoulder of a bottle at spaced points along the circumference of the shoulder.

23 Claims, 3 Drawing Sheets

BOTTLE CARRIER

FIELD OF THE INVENTION

This invention relates to bottle carriers of the type that support a flanged bottle by tabs which engage the underside of the flange. More particularly, the invention relates to a carrier of this type which is reinforced against tearing or other failure of the tabs.

BACKGROUND OF THE INVENTION

Beverage bottles are conventionally formed with a flange or shoulder that projects out from the neck. One type of carrier that has been designed to support such bottles in a simple economical manner employs a support panel containing bottle neck openings which are surrounded by tabs arranged in so-called starburst fashion. When the panel is pushed down over bottles aligned with the neck openings, the tabs are pivoted up so that their edges engage the underside of the bottle shoulders. A handle, usually in the form of finger holes in the panel, enables a person to grasp and lift the carrier and its supported bottles.

Because the entire weight of the bottles is supported by the neck opening tabs, they are of critical importance. If one or more of them are torn or missing, a significant portion of the circumference of the bottle flange will not be supported. The lifting stresses are then concentrated in the remaining tabs, and at times can be so great as to cause them to fail. Failure of a tab results in the lifting stresses being distributed more unevenly throughout the carrier support panel, increasing the chances of carrier failure.

Various means have been suggested to reinforce the support panel, including the use of additional plies of material to protect against tearing. Although such measures provide additional protection against tearing of the panel, particularly in the handle area, the risk of failure due to missing or defective starburst support tabs is still a threat.

It is therefore an object of the invention to provide a bottle support carrier which retains the simplicity and economy of the basic support tab design, but protects against the problems caused by missing or defective tabs.

BRIEF SUMMARY OF THE INVENTION

The invention employs a support panel comprised of upper and lower plies containing aligned bottle openings through which the necks of the packaged bottles extend. Each ply includes a plurality of foldably connected support tabs extending along portions of the periphery of the bottle openings, with the edges of the tabs remote from the tab fold lines engaging the underside of the bottle shoulders. If one or more tabs of a bottle opening in one ply are weak or missing, tabs associated with the aligned opening in the other ply will be positioned to withstand the lifting and carrying stresses. Further, twice as many support tabs can engage the bottle shoulders than in known designs. For example, if a bottle opening is normally provided with four adjacent tabs, the two-ply arrangement of the invention provides eight tabs to support the weight of the bottles and withstand the stresses of lifting and carrying the package.

The tab fold lines of the openings in one ply may be formed so as to extend transversely of the tab fold lines of the aligned openings in the other ply. This causes the edges of the tabs of aligned openings in the upper and lower plies to contact the shoulder of the associated bottle neck at different points on its circumference. The resulting staggered arrangement provides for contact substantially around the entire circumference of the bottle shoulders.

The lower ply may be comprised of flaps foldably connected to the upper ply along either one or both side edges of the upper ply. In either case the width of the flaps may be such that the flaps extend over substantially the entire width of the upper ply. The carrier is readily formed from a single rectangular blank, which is both economical to produce and simple to apply.

The features of the invention which enable it to provide the desired results are brought out in more detail in the description of the preferred embodiments, wherein the above and other aspects and benefits of the invention will readily be apparent.

DETAILED DESCRIPTION OF THE PREFERRED EMBODIMENTS

Figure 1:
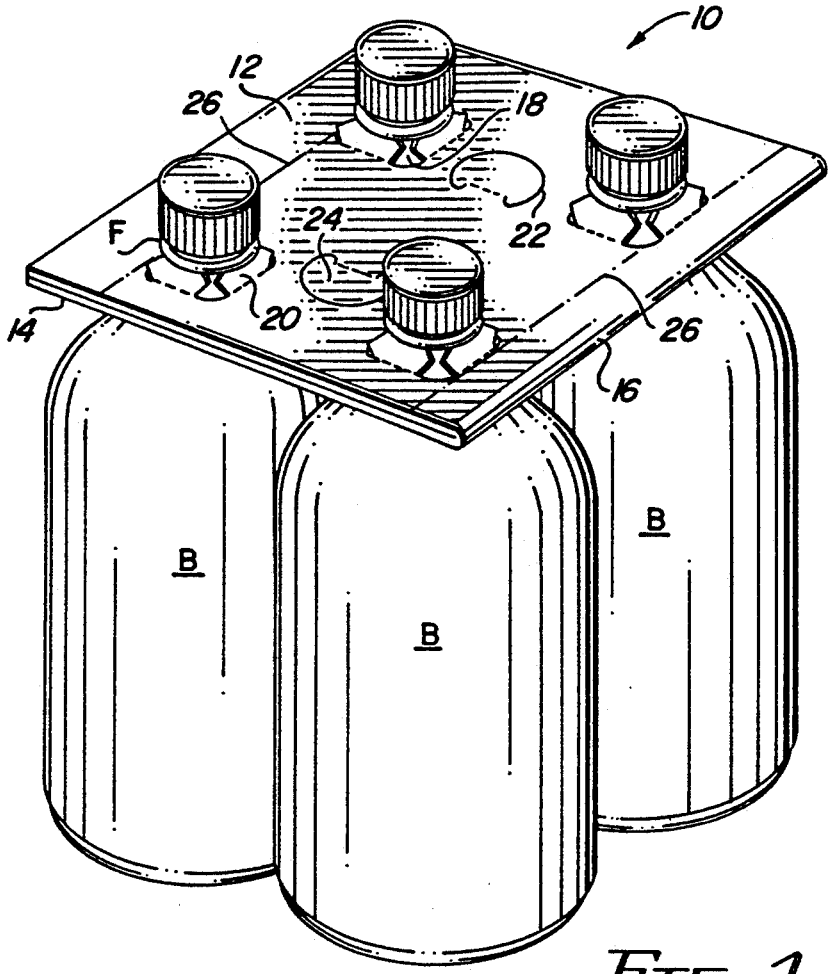
FIG. 1 is a pictorial view of one embodiment of the carrier of the invention.

Referring to FIG. 1, a carrier 10 is comprised of upper and lower plies 12 and 14, respectively, connected along fold line 16 to form a support panel. The upper ply 12 contains bottle neck openings 18, which are surrounded by support tabs 20 foldably connected to the support panel. The necks of bottles B extend up through the openings, with the underside of the bottle flanges F being engaged by the edges of the tabs. Finger holes 22, covered by foldably connected tabs 24, enable the carrier to be lifted by one's hand. In addition, the ply 12 includes score lines 26 which are parallel to and spaced from the side edges of the panel.

Figure 2:
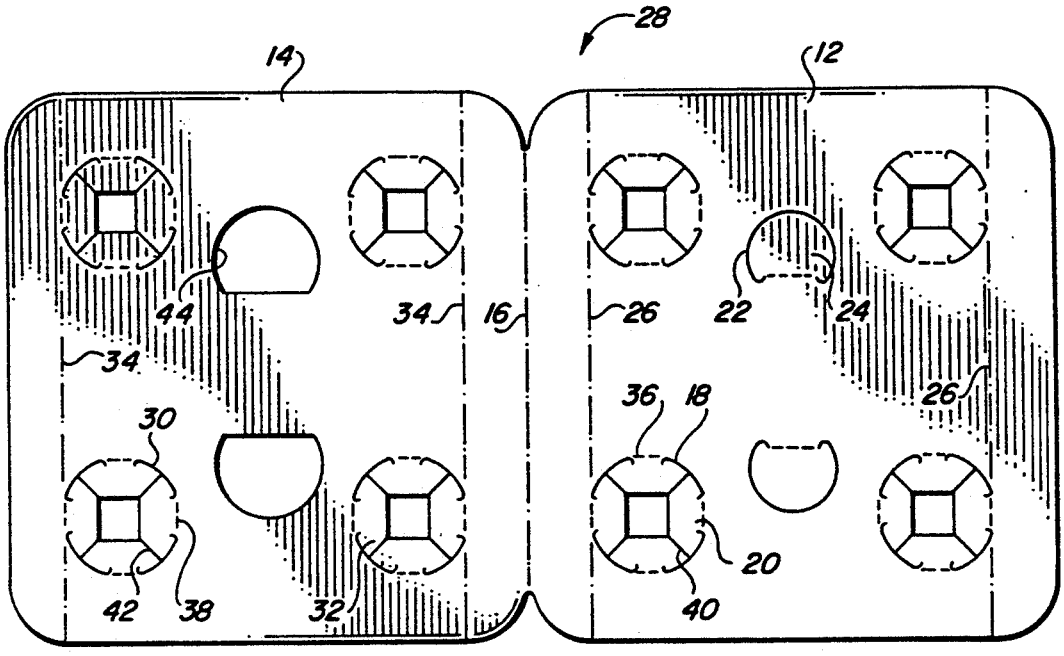
FIG. 2 is a plan view of a blank for forming the carrier of FIG. 1.

The support panel is formed from a unitary blank 28 of generally rectangular shape of the type shown in FIG. 2, wherein like reference numerals to those used in FIG. 1 denote similar elements. The lower support panel section 14 is basically identical to the upper support panel section 12, and includes bottle neck openings 30 and support tabs 32 similar to the openings 18 and tabs 20, as well as score lines 34 located similarly to the score lines 26. Fold lines 36 and 38 connect the support tabs 20 and 32, respectively, to their support panel sections, with slits 40 and 42 separating the tabs and extending from the outer support edges of the tabs to the fold lines 36 and 38. The tab fold lines of opposite pairs of tabs at each bottle neck opening are at right angles to each other, with one of the fold lines in the upper panel section 12 coinciding with the score lines 26 and one of the fold lines in the lower panel section 14 coinciding with the score lines 34. Uncovered finger holes 44 in the lower support panel section 14 are preferably slightly larger than the finger holes 22.

Figure 3:
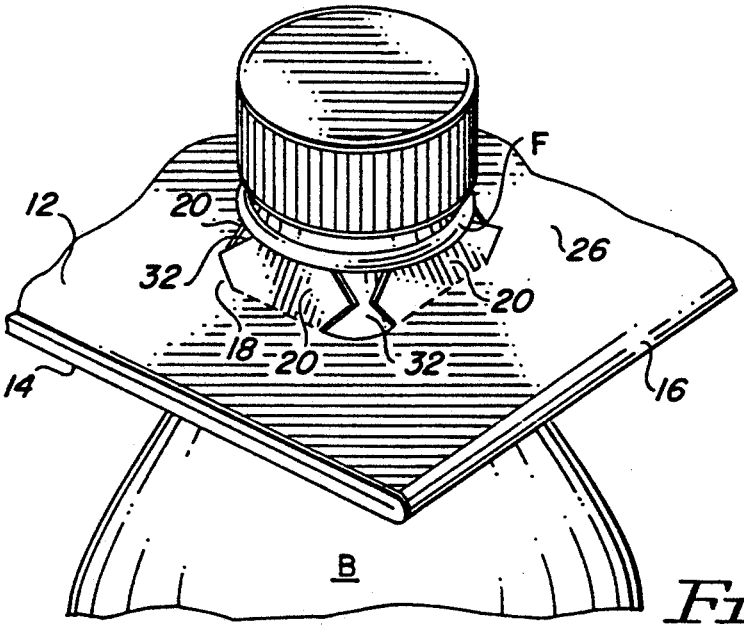
FIG. 3 is an enlarged partial pictorial view of the portion of the carrier enclosed in the circle 3 in FIG. 1, showing the neck of a bottle and the supporting tabs of the carrier.

To form a carrier package, the blank is simply folded along the central fold line 16 to bring the panel sections together in face-to-face relationship, resulting in a two-ply panel in which the bottle neck openings 18 and 30, the score lines 26 and 34, and the finger holes 22 and 44 are aligned. The panel is positioned over a group of bottles arranged as they are intended to be in the package, and is pushed down over the tops of the bottles until the support tabs 20 and 32 snap into place beneath the bottle flanges F. Because the support tabs of the bottle neck openings of each ply are aligned, the corresponding tabs of both plies snap into place beneath an associated bottle flange as a unit. This is best illustrated in FIG. 3, which shows both sets of tabs 20 and 32 extending up against the underside of the bottle flange F.

The carrier is quite inexpensive to produce and easy to apply. The plies may be glued together, but may remain unconnected if desired, since contact between the support tabs and the bottle flanges and between the lower support ply and the transition portion of the bottle between the neck and the barrel holds the unconnected edge of the lower ply in place.

Figure 4:
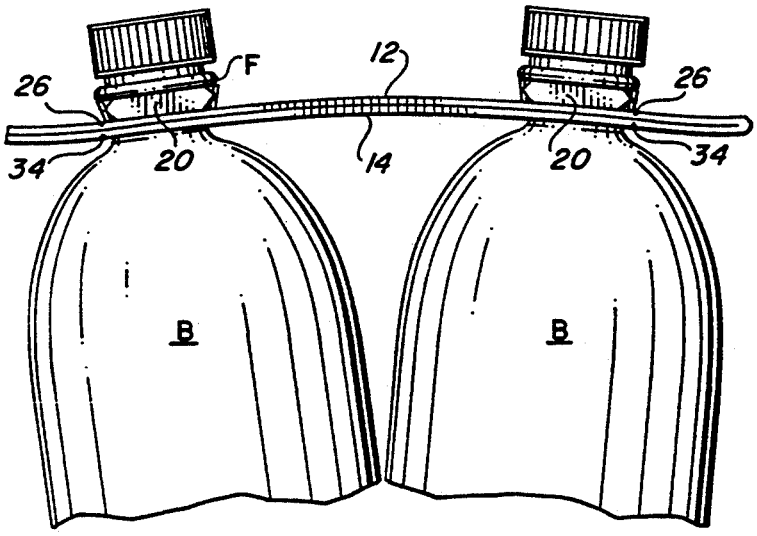
FIG. 4 is a partial end view of the carrier as it would appear during lifting.

When the package of FIG. 1 is lifted by the handle openings, the lifting stresses tend to bow the central portion of the support panel up slightly, as illustrated in FIG. 4, causing the support tabs in the bowed portion of the support panel to push up harder against the flanges F to lock the flanges more tightly in place. The outer support tabs would normally tend to be moved down by the bowing action out of tight engagement with the bottle flanges, but the longitudinal score lines 26 and 34 serve to distribute the stresses and prevent the outer tabs from moving out of engagement with the flanges. The slight angle formed at the score lines by the edge portions of the support panel and the bowed interior portion is illustrative of the stress forces in the carrier when the carrier is lifted by the handle openings. By locating the outer tab fold lines on the score lines, the ability of the score line to withstand and distribute lifting stresses along the length of the support panel minimizes or eliminates the risk of the outer tabs failing under the lifting stresses. The tendency of the bottles in adjacent rows to separate at their upper ends during lifting has been illustrated in a slightly exaggerated manner for emphasis.

It will be understood that although the carrier has been illustrated as being designed to hold four bottles, it can be enlarged to hold six or more.

Figure 5:
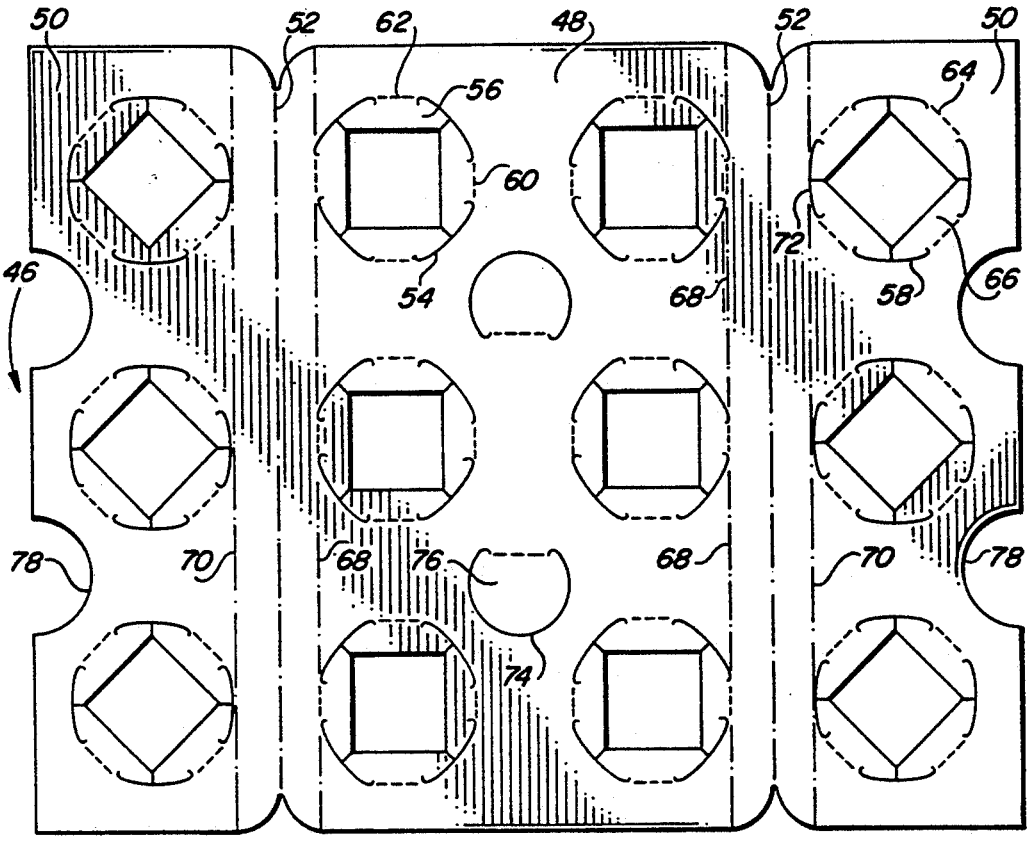
FIG. 5 is a plan view of a blank for forming another embodiment of the invention.

Referring now to FIG. 5, a modified carrier blank 46 includes a central support panel section 48 connected to reinforcing flaps 50 along fold lines 52. Because the illustrated blank is designed to form a carrier for supporting six bottles, the central support panel section is provided with six bottle neck openings 54 arranged in two rows of three each. The openings are similar to the bottle neck openings in the first embodiment, and are provided with tabs 56 similar to the tabs 20 in the first embodiment. Each reinforcing flap 50 includes three bottle neck openings 58 similar to the openings 54, except that the support tabs of the openings 58 are out of phase with the support tabs of the openings 54. Thus while the tabs 56 of the openings 54 in the central support panel section are arranged so that one pair of tab fold lines 60 extend longitudinally of the panel and the other pair 62 extend at right angles to the first pair, the fold lines 64 of the tabs 66 in the reinforcing flaps 50 are arranged transverse to the tab fold lines 60 and 62. As in the first embodiment, score lines 68 coinciding with the outermost tab fold lines 60 are provided in the central support section at locations spaced from and parallel to the fold lines 52, while score lines 70 are similarly provided in the reinforcing flaps. In the illustrated arrangement the openings 58 are 45° out of phase with the openings 54. Therefore, instead of the score line 70 coinciding with a tab fold line, it coincides with the slit 72 connecting adjacent tab fold lines. Finger openings 74 covered with foldably connected tabs 76 are provided in the central support section, while semicircular cutouts 78 in the side edges of the flaps 50 are located so as to be aligned with the finger holes when the flaps are folded into place.

Figure 6:
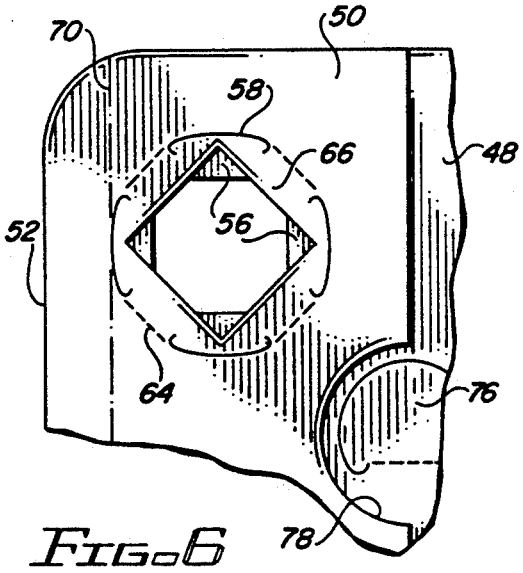
FIG. 6 is an enlarged plan view of one of the bottle openings in the underside of the carrier blank of FIG. 5 prior to applying the blank to the bottles to be packaged.

A carrier is formed by first folding the reinforcing flaps about their fold lines 52 so that they underlie the central support panel section 48 in face-to-face relationship, with the bottle neck openings 58 being aligned with the openings 54. The resulting tab arrangement is illustrated in FIG. 6, which shows two aligned bottle neck openings when viewed from the underside of the folded blank. It can be seen that the edges of the tabs 66 of the flap 50 are at 45° to the edges of the tabs 56.

Figure 7:
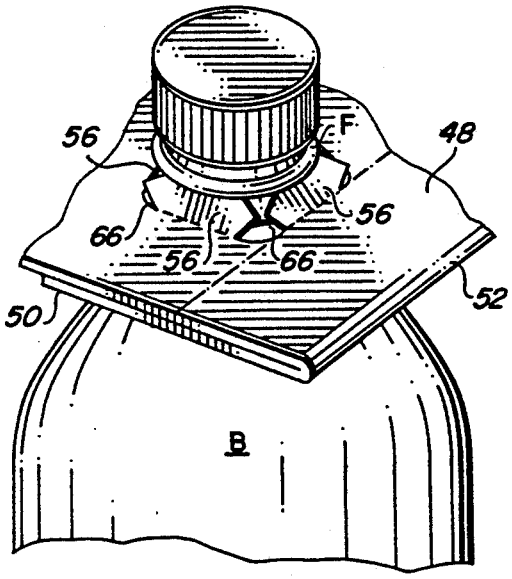
FIG. 7 is an enlarged pictorial view similar to that of FIG. 3, but showing a bottle neck and the surrounding support tabs of a carrier formed from the blank of FIG. 5.

When the folded blank is pushed down over the tops of a group of bottles in the manner explained in connection with the first embodiment, the tabs of the aligned openings are pushed up until they snap into place beneath the flange F of the bottles. As illustrated in FIG. 7, the outer edges of the tabs 56 of the central support section 48 engage the underside of the bottle flange F along four regularly spaced segments of the flange, while the outer edges of the tabs 66 of the reinforcing flap 50 engage the flange along four segments between the tabs 56. This results in substantially the entire circumference of the bottle flange being engaged and supported by the tabs 56 and 66. Thus if one or more of the tabs should happen to tear or be missing, a great majority of the bottle flange circumference will still be contacted by the remaining tabs. Although it is preferred to employ a four-tab arrangement, with the tab fold lines of one ply of the carrier forming an angle of 45° with the tab fold lines of the other ply, the number of tabs and the angles formed by their fold lines are largely a matter of design which can be modified if desired. For this embodiment, however, it is essential that the tab fold lines of one ply lie at a substantial angle with respect to the adjacent underlying or overlying tabs of the other ply in order for the tab edges to engage the bottle flange throughout most of its circumference. It has been found that if this angle is in the range of 35° to 55°, the tabs will be capable of contacting substantially the entire circumference of bottle flanges that are oval or otherwise not circular in shape.

With respect to the score lines 68 and 70, it will be understood that they provide the same function as the score lines 26 and 34 of the carrier in the first embodiment.

Although the bottles have been shown as having a relatively wide separate integral flange, the terms "flange" or "shoulder" as used in the specification and claims are intended to also apply to the underside of the bottle caps of bottles which do not have a separate flange.

It should now be clear that the carrier of the invention provides added support capability without departing from the basic support carrier design. Moreover, the carrier is economical to produce and does not require complicated application steps.

Because the invention need not be limited to all the specific details described in connection with the preferred embodiments, except as they may be within the scope of the appended claims, changes to certain features of the preferred embodiments which do not alter the overall basic function and concept of the invention are contemplated.

What is claimed is:

1. A carrier package for bottles having a neck portion which includes an outwardly projecting shoulder, comprising:

a support panel comprised of upper and lower plies containing aligned bottle openings through which the necks of the bottles extend; and a plurality of support tabs connected to each ply by fold lines extending along portions of the periphery of each bottle opening, the support tabs of each ply having edges remote from the tab fold lines for engaging the underside of the bottle shoulders.

2. A carrier package according to claim 1, wherein the lower ply is comprised of two flaps connected to the upper ply by fold lines extending along opposite edges thereof, the flaps terminating in adjacent edges.

3. A carrier package according to claim 1, wherein the lower ply is connected to the upper ply by a fold line extending along one of the edges of the upper ply, the lower ply extending substantially to the opposite edge of the upper ply.

4. A carrier package according to claim 1, wherein the tab fold lines of the openings in the upper ply extend transversely of the tab fold lines of the aligned openings in the lower ply, whereby the remote edges of the tabs of aligned openings in the upper and lower plies contact the shoulder of the bottle neck extending through the aligned openings at different points on the shoulder.

5. A carrier package according to claim 1, including aligned handle openings in the plies.

6. A carrier package containing bottles having a neck portion which includes an outwardly projecting shoulder, comprising:

a support panel comprised of upper and lower plies of material containing aligned bottle openings through which the necks of the bottles extend;

a plurality of support tabs connected to each ply by fold lines extending along portions of the periphery of each bottle opening, the support tabs having edges remote from the tab fold lines for engaging the underside of the bottle shoulders, the remote edges being substantially parallel to the fold line of the tab; and the tab fold lines of the openings in the upper ply extending transversely of the tab fold lines of the aligned openings in the lower ply, whereby the remote edges of the tabs of aligned openings in the upper and lower plies contact the shoulder of the bottle neck extending through the aligned openings at different points on the shoulder.

7. A carrier package according to claim 6, wherein there are four support tabs in each ply surrounding each bottle opening, and the fold lines of the tabs of a bottle opening in one ply form angles in the range of 35° to 55° with the fold lines of the tabs in the aligned bottle opening of the other ply.

8. A carrier package according to claim 7, wherein the angle formed by the fold lines of the tabs of a bottle opening in one ply with the fold lines of the tabs in the aligned bottle opening of the other ply is approximately 45°.

9. A carrier package according to claim 6, wherein the upper and lower plies are connected to each other along at least one fold line.

10. A carrier package according to claim 6, wherein the plies are comprised of paperboard.

11. A carrier package according to claim 1, wherein the upper and lower plies include aligned score lines spaced from and parallel to side edges of the support panel.

12. A carrier package according to claim 11, wherein the score lines of at least one ply substantially coincide with the fold lines of outer support tabs on said ply.

13. A blank for forming a carrier adapted to support bottles having a neck portion which includes an outwardly projecting shoulder, comprising:

an upper support panel section containing bottle openings through which the necks of bottles may extend;

at least one lower support panel section connected to at least one edge of the upper support panel section by a fold line and containing bottle openings through which the necks of bottles may extend, the bottle openings in the upper and lower support panel sections being located so as to be aligned when said at least one lower support panel section is folded into face-to-face relationship with the upper support panel section; and a plurality of support tabs connected to each support panel section by fold lines extending along portions of the periphery of each bottle opening, the support tabs having edges remote from the tab fold lines for engaging the underside of bottle shoulders.

14. A carrier blank according to claim 13, wherein the lower panel support section is comprised of two flaps connected to the upper panel support section by fold lines extending along opposite edges thereof, each flap being of a width so as to terminate adjacent the other flap in a carrier formed from the blank.

15. A carrier blank according to claim 13, wherein the lower panel support section is connected to the upper panel support section by a fold line extending along one of the edges of the upper panel support section, the lower panel support section being of a width to so as extend substantially to the opposite edge of the upper panel support section.

16. A carrier blank according to claim 13, wherein the blank is comprised of paperboard.

17. A carrier blank according to claim 13, wherein the tab fold lines of the openings in the upper support panel section extend transversely of the tab fold lines of the openings in the lower support panel section, whereby the remote edges of the tabs of aligned openings in a carrier formed from the blank contact the shoulder of the bottle neck extending through the aligned openings at spaced points along the circumference of the shoulder.

18. A carrier blank according to claim 17, wherein the remote edge of each tab of a bottle opening is substantially parallel to the fold line of the tab.

19. A carrier blank according to claim 17, wherein there are four support tabs in each ply surrounding each bottle opening, and the fold lines of the tabs of a bottle opening in one ply are adapted to form angles in the range of 35° to 55° with the fold lines of the tabs in the aligned bottle opening of the other ply in a carrier formed from the blank.

20. A carrier blank according to claim 19, wherein the angle formed by the fold lines of the tabs of a bottle opening in one ply with the fold lines of the tabs in the aligned bottle opening of the other ply is approximately 45°.

21. A carrier blank according to claim 17, wherein the remote edges of adjacent tabs of the bottle openings in each panel support section terminate in adjacent ends.

22. A carrier blank according to claim 13, wherein the upper and lower support panel sections include score lines spaced from and parallel to side edges of the panel sections, the score lines being located so as to be aligned in a carrier formed from the blank.

23. A carrier blank according to claim 22, wherein the score lines of at least one support panel section substantially coincide with the fold lines of outer support tabs on said panel section.

* * * * *